US011383914B2

(12) United States Patent
Fisher et al.

(10) Patent No.: US 11,383,914 B2
(45) Date of Patent: Jul. 12, 2022

(54) DUAL PURPOSE FOOD PACKAGING REFILL CONTAINER AND WASTE RECEPTACLE

(71) Applicants: Chad William Fisher, Centennial, CO (US); Riccardo James Tresso, Oro Valley, AZ (US)

(72) Inventors: Chad William Fisher, Centennial, CO (US); Riccardo James Tresso, Oro Valley, AZ (US)

( * ) Notice: Subject to any disclaimer, the term of this patent is extended or adjusted under 35 U.S.C. 154(b) by 20 days.

(21) Appl. No.: 16/900,890

(22) Filed: Jun. 13, 2020

(65) Prior Publication Data

US 2020/0391931 A1 Dec. 17, 2020

Related U.S. Application Data

(60) Provisional application No. 62/860,854, filed on Jun. 13, 2019.

(51) Int. Cl.

| | |
|---|---|
| ***B65D 83/00*** | (2006.01) |
| ***B65F 1/06*** | (2006.01) |
| ***B65D 77/06*** | (2006.01) |
| ***B65D 25/04*** | (2006.01) |

(52) U.S. Cl.

CPC ..... *B65D 83/0055* (2013.01); *B65D 25/04* (2013.01); *B65D 77/06* (2013.01); *B65F 1/06* (2013.01); *B65D 2209/00* (2013.01)

(58) Field of Classification Search

CPC ..... B65F 1/06; B65D 77/06; B65D 25/04; B65D 83/0055; B65D 35/22; B65D 25/52; B65D 2209/00; B65D 47/2031; Y10S 220/916; A47K 10/424; A47K 10/46

USPC ..... 222/92–107, 214, 212, 209; 221/64, 35, 221/102

See application file for complete search history.

(56) References Cited

U.S. PATENT DOCUMENTS

| | | | | |
|---|---|---|---|---|
| 2,741,559 | A | 4/1956 | Banowitz | |
| 3,355,080 | A * | 11/1967 | Rausing | B65D 25/14 229/123.1 |
| 3,498,798 | A | 3/1970 | Baur | |
| 4,078,686 | A | 3/1978 | Karesh | |
| 4,151,910 | A | 5/1979 | Yasur | |
| 4,416,197 | A * | 11/1983 | Kehl | B65F 1/068 100/214 |
| 4,444,324 | A | 4/1984 | Grennel | |
| D323,615 | S | 2/1992 | Carlstrom | |
| 5,325,765 | A | 7/1994 | Sylvan | |
| 5,840,189 | A | 11/1998 | Sylvan | |
| 5,860,567 | A * | 1/1999 | Fuchs | B05B 11/3036 222/105 |

(Continued)

*Primary Examiner* — Vishal Pancholi
*Assistant Examiner* — Robert K Nichols, II
(74) *Attorney, Agent, or Firm* — Strategic Patents LLC; Bret W Adams

(57) ABSTRACT

A dual purpose food packaging refill and waste receptacle is disclosed. The receptacle is substantially impervious to passage of oxygen and water, thus, preserving freshness of snack foods, such as sunflower seeds or nuts. The receptacle includes a food grade bag affixed to pliable or semi-rigid cylinder that may be sealed at the opening. Once the receptacle is opened and the contents extracted, such as being emptied into a separate container, the packaging serves as a receptacle for residual material that is inedible or otherwise disposable by the consumer.

13 Claims, 8 Drawing Sheets

(56) References Cited

U.S. PATENT DOCUMENTS

| | | | | |
|---|---|---|---|---|
| 5,875,936 | A * | 3/1999 | Turbett | B05B 11/3032 222/207 |
| 6,062,430 | A | 5/2000 | Fuchs | |
| 6,092,717 | A | 7/2000 | Lowry | |
| 6,196,412 | B1 | 3/2001 | Cattell | |
| 6,264,068 | B1 | 7/2001 | Ours | |
| 6,398,071 | B1 | 6/2002 | Fellers | |
| 6,484,897 | B1 | 11/2002 | Crawley | |
| 6,591,874 | B2 * | 7/2003 | Credle, Jr. | B65D 75/5877 141/10 |
| 6,676,009 | B1 | 1/2004 | Rose | |
| D602,781 | S | 10/2009 | Balkum | |
| 7,866,500 | B1 | 1/2011 | Peggs | |
| 7,882,991 | B2 | 2/2011 | Schecter | |
| 7,946,422 | B1 | 5/2011 | Bjerke | |
| 8,074,841 | B1 | 12/2011 | Craig | |
| 8,225,955 | B2 | 7/2012 | Moskow | |
| 8,302,810 | B2 | 11/2012 | Mulhem | |
| D673,048 | S | 12/2012 | Waite | |
| 9,289,083 | B2 | 3/2016 | Lee | |
| 2002/0155202 | A1 | 10/2002 | Rebhorn | |
| 2005/0161424 | A1 | 7/2005 | Hogan | |
| 2006/0226171 | A1 | 10/2006 | Sternberg | |
| 2007/0012701 | A1 | 1/2007 | Amormino | |
| 2009/0057332 | A1 | 3/2009 | Arzola | |
| 2009/0224002 | A1 | 9/2009 | Bakhos | |
| 2010/0193459 | A1 | 8/2010 | Housley | |
| 2015/0158632 | A1 | 6/2015 | Wilhelm | |
| 2017/0050763 | A1 | 2/2017 | Gharibjanians | |
| 2017/0348715 | A1 | 12/2017 | Beer | |

* cited by examiner

DUAL PURPOSE FOOD PACKAGING REFILL CONTAINER AND WASTE RECEPTACLE

CROSS-REFERENCE TO RELATED APPLICATIONS

The present application claims priority to U.S. Provisional Patent Application No. 62/860,854, filed 13 Jun. 2019 and titled "Snack Food Refill and Disposal Packaging," the full disclosure of which is hereby incorporated herein by reference in their entireties for all purposes.

TECHNICAL FIELD

The technology described herein relates to a receptacle for storing edible food items, the remnant waste products of the food items, and a system having a container which can receive the receptacle.

BACKGROUND

Many situations exist where people consume food products that result in a residual material that is inedible. A common example is sunflower seeds and the inedible shells containing the seeds. Other food examples include peanuts, walnuts, pistachios, pumpkin seeds, pitted fruits such as grapes or cherries, and the like. When consuming these foods, the consumer needs a place to discard residual, inedible material. However, these types of food are often sold in packaging that doesn't provide a convenient container for collecting the residual waste material, such as common sunflower seed bags. Typically, these types of snack foods are sold in simple plastic bags that only hold the original product and many have an integrated Ziploc® type seal to keep the snack food fresh in the bag between consumption periods. As such, a typical consumer would not find it desirable to discard, for example, inedible sunflower or peanut shells in the same packaging having uneaten sunflower seeds or peanuts therein. In addition, these foods are often enjoyed by consumers in locations that don't naturally provide a convenient container for collecting the residual waste material, such as ball fields, sports arenas, theaters or automobiles. Trash cans and other waste disposal containers may not be immediately or conveniently accessible by the consumer, and as a result, consumers may discard the inedible portion of the food products on the ground, resulting in a dirty environment littered with shells or other waste remnants. In order to keep these, typically public, environments and facilities clean, cleaning crews expend significant effort to vacuum, sweep and pick-up these shells and waste remnants. Equipment used for cleaning, such as vacuums, must be routinely replaced from wear and tear, which is a substantial expense to the facility operator. As a result, many ball field facilities prohibit the consumption of sunflower seeds on their premises. Furthermore, spitting shells out of one's mouth, to the environment around them, which is typically the ground, raises hygiene and cleanliness concerns. Recently, spitting of sunflower seed shells has been banned (at least for now) from some professional sport events.

The information included in this Background section of the specification, including any references cited herein and any description or discussion thereof, is included for technical reference purposes only and is not to be regarded subject matter by which the scope of the invention as defined in the claims is to be bound.

SUMMARY

In order to address the deficiencies discussed in the background section, we have developed novel snack food refill and disposal packaging that keeps snack food fresh, is conducive to and compatible with common snack food store displays and serves as a convenient, readily available receptacle for inedible waste.

In one example of the present disclosure, A dual purpose receptacle for edible food items, comprising a ring having a first shape and a first opening at a first end and a second opening at a second end opposite the first end; a flexible bag coupled to the ring, the flexible bag having an opening at a first end to allow access to an inner volume of the flexible bag for storing edible food items and receiving remnant waste of said edible food items, and wherein the bag is sealed at a second end opposite the first end; a ring seal provided at least partially in contact with the flexible bag, the ring seal configured to couple the flexible bag to the ring and to form an impervious air-tight and water-tight barrier; and a top seal coupled to the first end of the ring, the top seal configured to form an impervious air-tight and water-tight barrier for the inner volume of the flexible bag. The flexible bag and ring seal may be at least partially inserted in the ring, and wherein the inner volume of the flexible bag is accessible through the first opening of the ring and the first end of the flexible bag.

In another example of the present disclosure, a system for storing edible food items and the remnant waste of said edible food items, comprising: a squeezable container assembly comprising a main body having a first opening at a first end and a second opening at a second end opposite the second end; a first compartment formed by an inner volume of the main body; and a first cap coupled to the main body at the first end, a second cap removably coupled to the main body at the second end, the first comprising an aperture configured to allow access to the first compartment. The system may further comprise a dual purpose receptacle comprising a ring having a first shape and a first opening at a first end and a second opening at a second end opposite the first end; a flexible bag coupled to the ring, the flexible bag having an opening at a first end to allow access to an inner volume of the flexible bag for storing edible food items and receiving remnant waste of said edible food items, and wherein the bag is sealed at a second end opposite the first end; a ring seal provided at least partially in contact with the flexible bag, the ring seal configured to couple the flexible bag to the ring and to form an impervious air-tight and water-tight barrier; and a top seal coupled to the first end of the ring, the top seal configured to form an impervious air-tight and water-tight barrier for the inner volume of the flexible bag. The flexible bag and ring seal may both be at least partially inserted in the ring, and the inner volume of the flexible bag may be accessible through the first opening of the ring and the first end of the flexible bag. In one example the dual purpose receptacle of the system is inserted at least partially into the inner volume of the main body of the squeezable container at a second end thereof, wherein the inner volume of the flexible bag forms a second compartment of the squeezable container assembly, the second compartment accessible via an aperture in the second cap of the squeezable container.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

BRIEF DESCRIPTION OF THE DRAWINGS

In order to further explain the present disclosure the follow figures are provided.

DETAILED DESCRIPTION

General Overview

Figure 1:
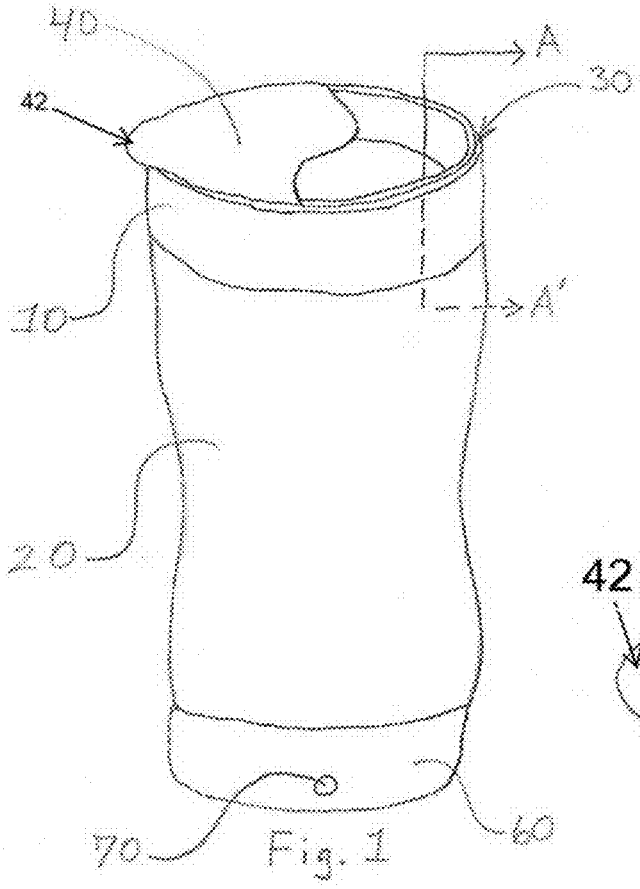
FIG. 1 is a side view of the packaging.
Figure 2:
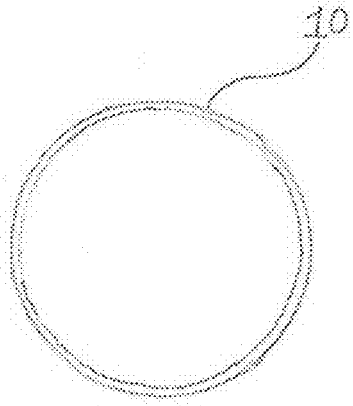
FIG. 2 is a top view along the central axis of the pliable ring with seal removed.

The snack food refill and disposal packaging of the present disclosure includes a flexible or pliable ring which may be semi-rigid, a plastic bag permanently joined to the ring interior, and a ring cover or seal. The ring may be substantially cylindrical, or other suitable shape, constructed of any conventional material but is preferably material sufficiently rigid to withstand handling and shipping loads, substantially impervious to passage of gases so that oxygen and water vapor and other potential contaminants are precluded from entering the package and causing snack food staling, and a material that is somewhat flexible when squeezed from opposite radial points. Further, the ring and seals may also operate to contain an inert gas, such as nitrogen, inside the packaging, if applicable, to keep food items fresh. The ring may be shaped to conform to the shape of another container, such as the SQEEDS® container referenced below, in which the packaging may be configured to be inserted.

In some examples the ring could be a metallic, tin or aluminum plate structure commonly used in the manufacture of cans. An embodiment of the ring may include fiber board, paper board or cardboard material that is constructed with a layer of metallic foil, laminate barrier film, or the like, on the inside of the ring. The metallic foil or laminate film, such as for example Flexi FoilFree HB ultra-high barrier film from ProAmpac, may function as a barrier to the passage of oxygen and water vapor. The plastic bag is a food grade material such as for example polyethylene, as is well known in the art. Alternatively, a food-grade compostable material may used to form the bag.

The outside surface of the plastic bag opening, opposite the interior volume, may be attached to the inside of the ring with a seal that is substantially impervious to oxygen and water vapor. The metallic foil or barrier film may be attached to both the inside of the plastic bag opening and the inside of the ring, affixing the bag and ring together and creating a barrier substantially impervious to oxygen, water vapor, or other such contaminants. The other end of the bag, i.e., the side not affixed to the ring, is sealed closed, for example with a heat seal operation. The open end of the ring, corresponding to an open end of the bag which allows access to the interior volume of the bag, may also be sealed with a foil seal or membrane to keep the contents fresh.

In use, a consumer may peel back the foil seal, which may be provided with a pull-tab, and remove the foil seal to access the edible food items in the packaging. In addition, the outside of the ring, plastic bag and top foil seal can be labeled, through various means obvious to those skilled in the art which includes but is not limited to adhering a label or printing, to indicate the name and character (e.g. food type, flavor, and the like) of the product and/or the product therein packaged.

Snack filled bags are typically slid onto small rods, attached to store display cases, through a small hole in the top of the bag. The packaging of the present disclosure includes a small hole in the plastic bag at the bottom, below the seal at the bottom of the plastic bag (i.e., at a side opposite the bag opening allowing for access to the interior volume of the bag). This allows the packaging of the present disclosure described herein to be displayed in stores on small rods and other displays.

Once the packaging of the present disclosure is opened by a consumer by pulling the top seal off of the ring and the snack food contents is transferred into a Squeezable Container and Dispenser Assembly (and Method of Use), such as SQEEDS® (see for example co-owned U.S. patent application Ser. No. 16/057,816 "the '816 application" and PCT application number PCT/US18/45688, the full disclosures of which are hereby incorporated herein by reference in their entireties for all purposes, the packaging of the present disclosure is well adapted for use in the aforementioned Squeezable Container and Dispenser Assembly (and Method of Use) as a convenient container for collecting the residual waste material from the aforementioned snack food, keeping the waste separated from the fresh snack food. In this example, the remaining packaging of the present disclosure is inserted into the inner diameter of the top end of a SQEEDS cylinder container and held in place with the cylinder and top cap. The packaging provides variable volume separation barrier between the fresh snack food in the SQEEDS cylinder and the inedible snack food waste. As material in the container is consumed from one end and deposited in the other end, the bag expands, varying the volume of each SQEEDS chamber, to conveniently hold all the deposited waste material that results from consuming the fresh snack food that was transferred from the original packaging bag, now acting as a receptacle for waste material, to the SQEEDS cylinder. Once the snack food is consumed and the remaining packaging of the present disclosure full with inedible snack food waste, the packaging may be conveniently removed from the SQEEDS container and discarded in a trash receptacle and, the cycle repeats, as a new packaging of the present disclosure with fresh snack food may be purchased and the packaging again used to collect the inedible snack food waste. Thus, the present disclosure offers a more sanitary option for users to consume food with residual waste, such as sunflower seeds. Since the residual waste is deposited into, for example, the packaging bag in the SQEEDS® cylinder, it is not spit into the environment around the consumer. The residual waste and the corresponding body fluid that naturally occurs when spitting something out of one's mouth, is captured and contained in the waste material receptacle in the SQEEDS® cylinder.

In addition, the packaging of the present disclosure can be used more than once as a convenient container for collecting inedible food waste. Shells or other contented collected within the packaging could be dumped out of the packaging, into a trash receptacle, and the packaging used again for collecting food waste.

Description of Exemplary Embodiments

An exemplary snack food refill and disposal packaging according to the present disclosure is shown in FIG. 1. The primary parts are the pliable ring or cylinder 10, the bag 20, the ring seal 30 and the top seal 40. The completed packaging may also include adhesive (not shown) used in production to affix the bag 20 to the ring 10 and affix the top seal 40 to the ring 10. The ring seal 30 may also optionally include an adhesive or other structure for attaching to the cylinder 10 and bag 20.

Figure 4:
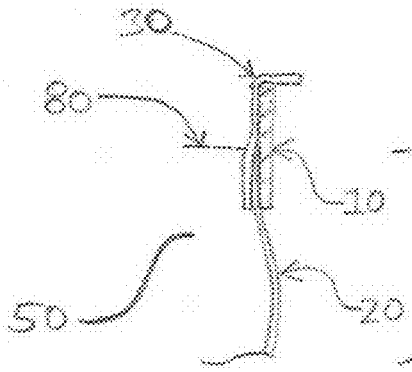
FIG. 4 is a fragment view along A-A' showing the sealing membrane on the ring side wall before being secured thereto.
Figure 5:
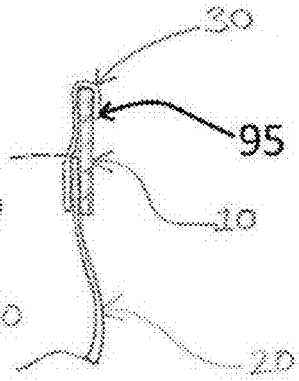
FIG. 5 is a fragment view along A-A' showing the sealing membrane on the ring side wall after being secured thereto.
Figure 6:
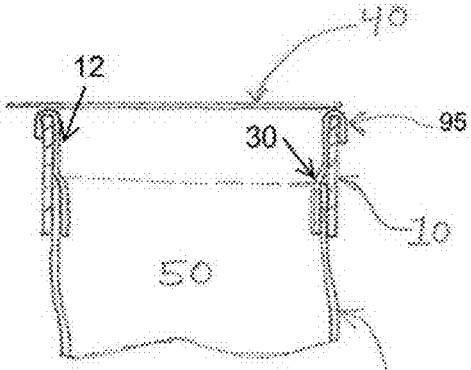
FIG. 6 is a partial cross section view of FIG. 1 illustrating the seal, pliable ring and a portion of the bag.
Figure 7:
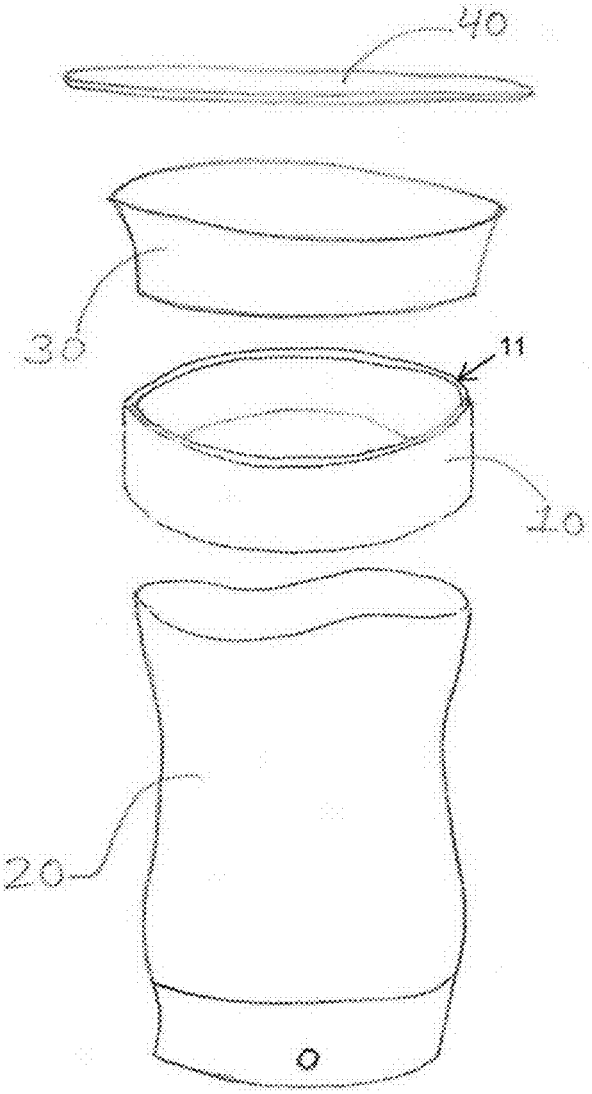
FIG. 7 is an exploded view of the packaging.
Figure 11:
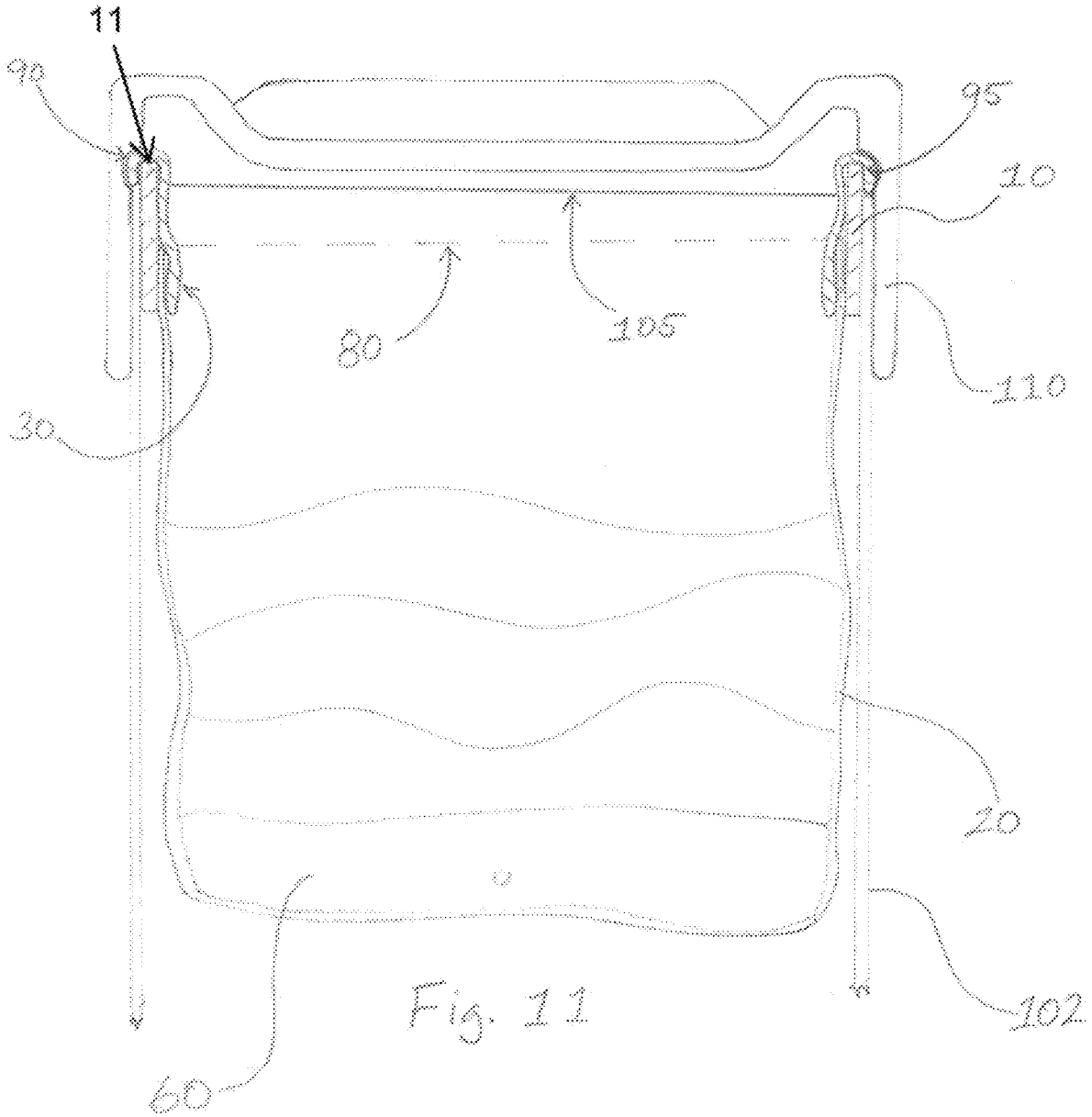
FIG. 11 is a cross section view showing the opened packaging installed in a squeezable container and dispenser assembly.

The four pieces are assembled as shown in the exploded view in FIG. 7 to create the packaging system. As shown in the cross-section in FIG. 6, the bag 20 may be inserted at least part-way into the inner diameter of the ring 10. The outer diameter of the top opening 80 of the bag 20 is affixed to the inner diameter of the ring 10, which may be accomplished with adhesive, heat, ultrasonic welding, microwave energy, and the like. A foil (or other laminate material) ring seal 30, which may serve as a bag-to-top seal and auxiliary coupling member, is layered over the interior surface of the bag 20 proximate the opening 80 and may be provided over a portion 12 of the inner surface of the ring 10 where the bag 20 is not provided, as shown in FIG. 6. As shown in FIG. 4, the material of the ring seal 30 may be at least partially wrapped over the top rim 11 of the ring 10 and may adhere to a small portion of the outside surface of the ring 10 as shown in FIG. 5. Alternatively, the ring seal 30 may rest or seat on top of the rim 11 of the ring 10. The ring seal 30 seals and couples the bag 20 and the ring 10 together, provides a suitable material to affix the top seal 40 to seal the packaging closed, and creates a lip of material that seats into the top cap 110 channel 90 of a SQEEDS container as shown in FIG. 11.

Figure 3:
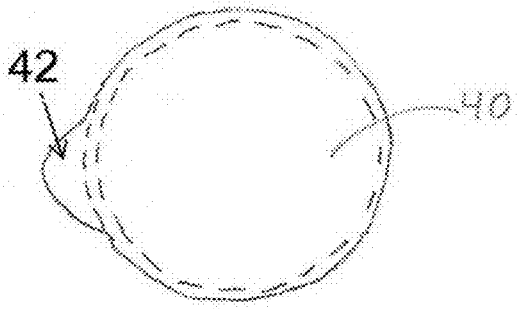
FIG. 3 is a top view with the seal provided over the pliable ring.

A pull-tab 42 may be included on the top seal 40 as shown in FIG. 1 and FIG. 3. The top seal 40 may be formed from a foil material to be impermeable to water vapor and air (or nitrogen or other gas purged into the bag 20 at time of food stuffs production), and may be referred to as a top seal 40 or a foil seal 40. The top seal 40 may have a paper backing with a foil layer formed thereon, and may accept printing ink or other marking material to allow for a design, logo, or other indicia to be provided on the side visible to the consumer (e.g., the outside surface opposite the compartment which holds the food material).

Figure 8:
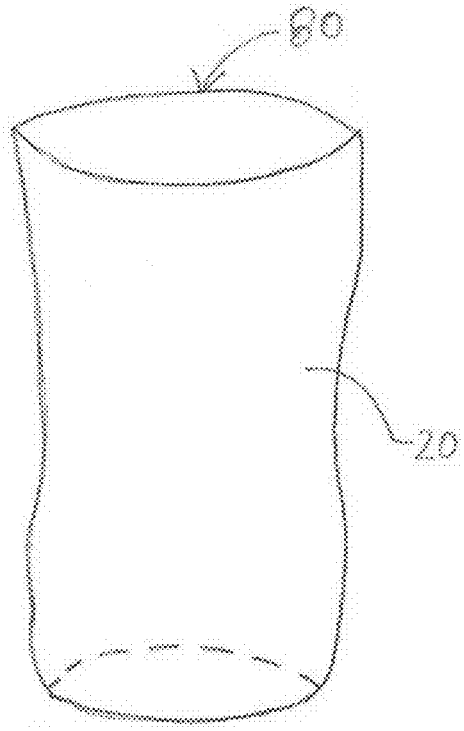
FIG. 8 is a view of the bag that may start as a tube.
Figure 9:
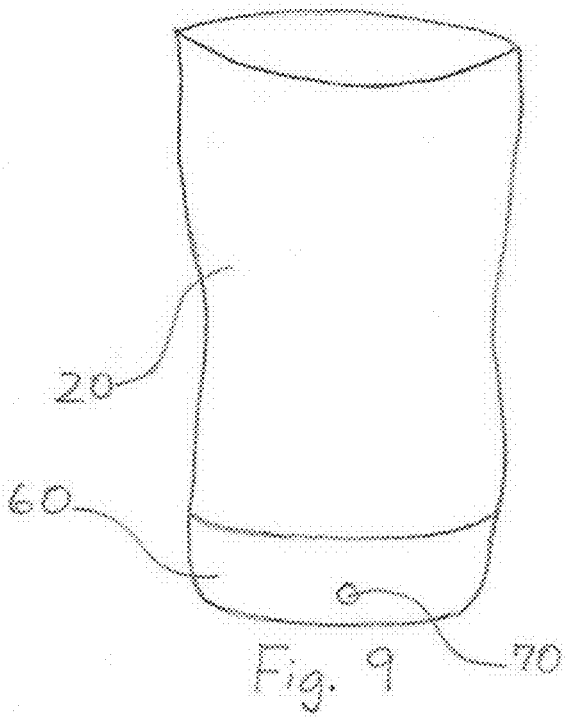
FIG. 9 is a view of the bag after the sealing one end and creating a hole for display on a hanging post.

FIG. 8. shows the bag 20 which may start as a tube of plastic material, or the like, with open ends at both the top 80 and the bottom. The bag 20 may then be sealed at the bottom 60 with a heat seal process, adhesive or other process for forming a closed end. In some examples the bottom 60 may form a "flange" or otherwise flattened portion with two sides of the bag 20 heat-welded together. A hole 70 may be added to the bottom 60 sealed area outside of the snack food container volume 50. This hole 70 may be placed in a position which will reduce the likelihood of the hole ripping through the material of the bottom area 60 of the formed bag 20, and may be sized to cooperate with existing store display structure, such as rods or posts designed for for hanging food items on display.

During use, a consumer opens the packaging by pulling off the top seal 40 and may then transfer the snack food contents to a Squeezable Container and Dispenser Assembly (and Method of Use), such as a SQEEDS® container disclosed in co-owned U.S. patent application Ser. No. 16/057,816 and PCT application number PCT/US18/45688, the full disclosures of which are hereby incorporated herein by reference in their entireties for all purposes. The packaging may then be inserted into the top of the Squeezable Container and Dispenser Assembly as shown in the exploded view in FIG. 10. The body of the bag 20 and ring 10 assembly may be inserted into the top end 105 of the cylinder 102 opening 104. That is, the ring 10 may have a diameter slightly smaller than the inner diameter of the SQEEDS or other container for which the presently disclosed packaging is configured for. The ring 10, with the bag 20 coupled thereto, is slid into the opening 104 of the cylinder 102, thus forming a variable volume for receiving food waste material. As mentioned above, fresh food material 22, such as for example sunflower seeds, has been transferred into the interior volume 107 by way of the opening 104 or the opening 106. Thus, the interior volume 107 has been divided into a fresh food sub-volume and a waste material sub-volume formed by, for example, the bag 20. Although not illustrated in the drawings, the bag 20 may accept printing ink or other marking material to allow for a design, logo, or other indicia to be provided on the side visible to the consumer (e.g., the outside surface opposite the compartment which holds the food material).

When placing the ring 10 into the cylinder opening 104, a small portion of the ring seal 30 proximate the opening of the ring 10 may extend over the top rim of the ring 10, as shown as in FIG. 5. This creates a lip 95 on the top of the outside surface of the ring 10. The lip 95 may be provided over the top of the top rim 11 (FIG. 7 of the ring 10 during the manufacturing process, and/or at least a portion of the lip 95 may be left unattached to the rim 11 and the end-user may wrap all or a portion of the lip 95 over the ring 10 such that at least a portion of the lip 95 sits on the rim 11 of the ring 10. In other examples, the seal material lip 95, if not adhered to an outer surface of the ring 10 may optionally be wrapped over and interface with the top rim 105 of the cylinder 102 at the cylinder opening 104. The top-cap 110 is then slipped over the ring 10 and foil ring seal 30 assembly and cylinder 102 covering the opening to the packaging ring 10 and cylinder 102. The top-cap 114 is pushed down over the cylinder 102 until the ring seal 30, or more specifically the material lip 95 in FIG. 11, on resting on the top rim 11 or the outside surface of the ring 10 is fully seated into the top-cap 110 seating channel 90. That is, the top cap 110 may include a seating channel 90, such as an indented channel, extending around at least a portion of the circumference on the inner surface of the top cap 110. The seating channel 90 may cooperate to help retain the top cap 110 snugly on the cylinder 102 by forming a frictional or interference fit with the lip 95, which may be snugly fit within the opening 104 of the cylinder 102. In some examples, the lip 95 may be placed by the user such that it wraps around an outer surface of the cylinder 102 proximate the rim 105 and opening 104.

Figure 14:
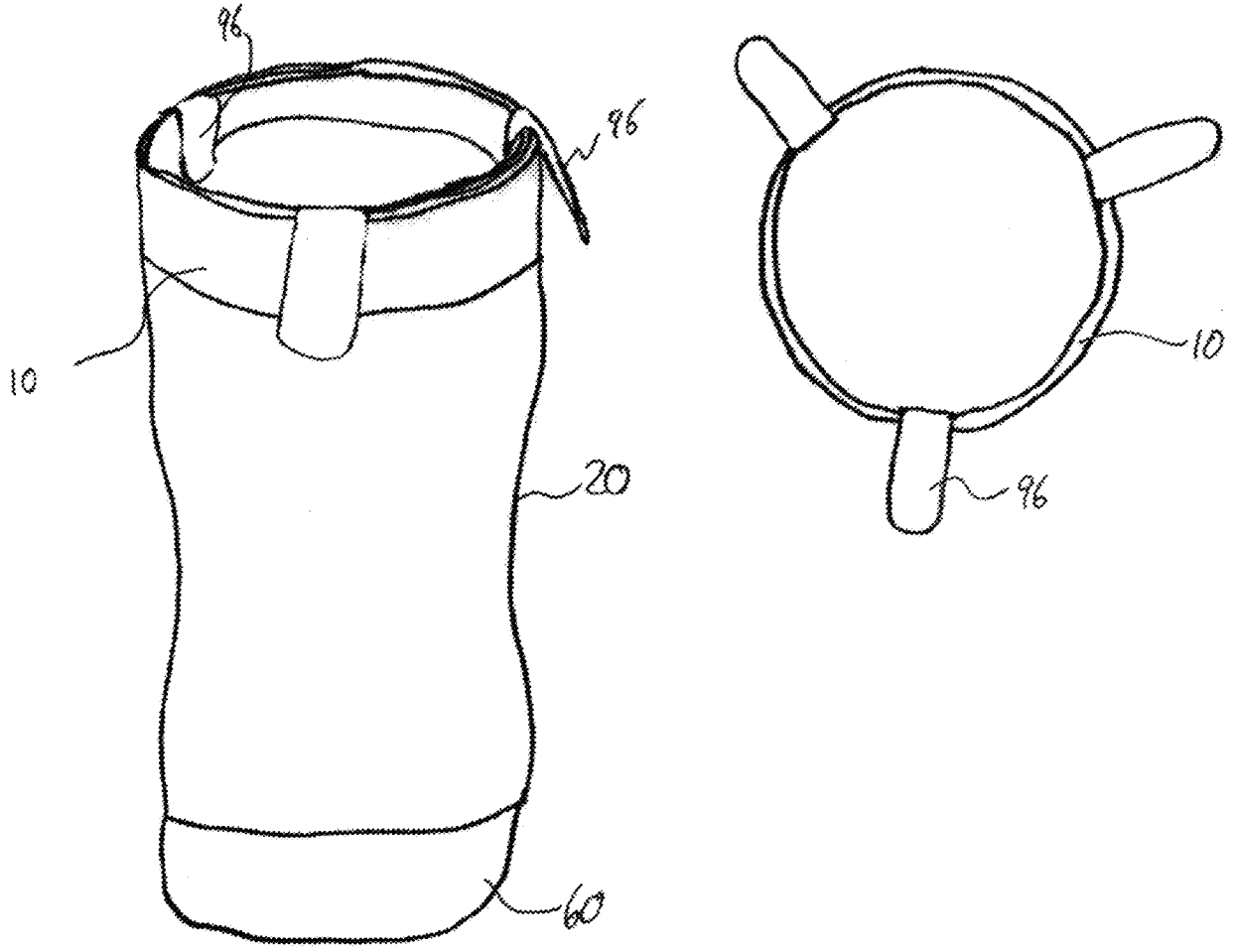
FIG. 14 illustrates another example of the packaging for use in a system of FIG. 10.

As illustrated in FIG. 14, in some examples one or more tabs may also or alternatively be provided on the lip 95, and the user (not shown) may wrap the one or more tabs 96 over the top rim 105 of the cylinder 102 (see FIG. 10) to securely position the bag 20 and rim 10 within the cylinder 102. In all examples, when seated over the material lip 95 and cylinder 102 top end rim 105, the top-cap 110 may be snug, requiring some force to remove (such as active removal by the user) and may not simply fall-off during normal use such as by the weight of the waste material in the bag 20, no matter the orientation. In some examples, tabs 96 may include an adhesive such as glue, pressure sensitive adhesive, and the like, to secure the bag 20 to the cylinder 102. However, adhesive may also be excluded and the tabs 96 designed to provide a frictional fit between the cylinder 102 and cap 110.

FIG. 11. shows a cross section view of the packaging assembled into a SQEEDS container as the disposal packaging for inedible food waste. Squeezing the assembly in FIG. 11 at opposing sides of top cap 110 along the axis of the top cap slit 114 provides the consumer with access to deposit residual food waste into the packaging of the present disclosure that is inserted into the SQEEDS cylinder 102. Further detail on the operation of the SQEEDS container may be found in U.S. patent application Ser. No. 16/057,816 and/or Ser. No. 29/659,284, and/or PCT application number PCT/US18/45688. The bag 20, ring 10, and seals 30, 40 may be used with the SQEEDS container, but they are not limited to this and may be sized and shaped to cooperate with substantially any container. Furthermore, although discussed in the context of storing fresh food and food waste, the present disclosure may find additional benefit in storing items which should be stored separately, such as certain medicines, dog treats, allergenic items separate from non-allergenic items, and the like.

Figure 12:
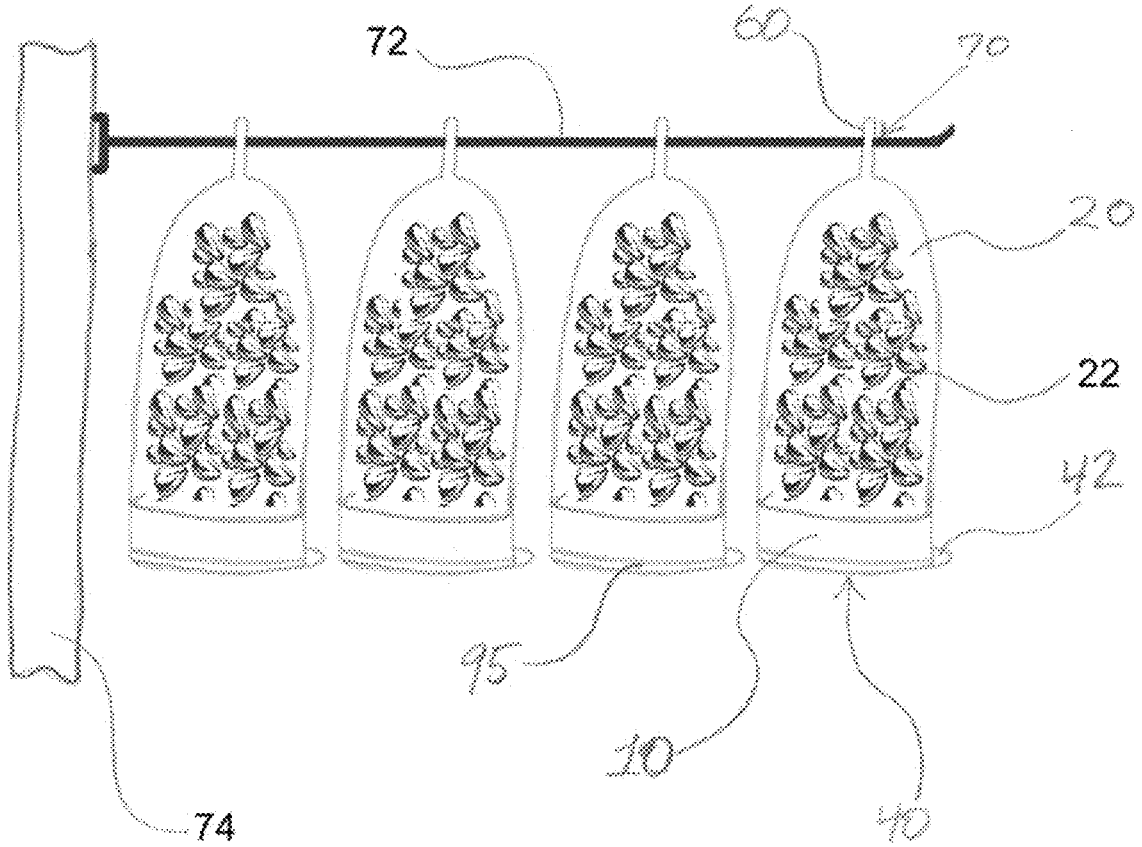
FIG. 12 illustrates a side view of multiple packages of food items on display.
Figure 13:
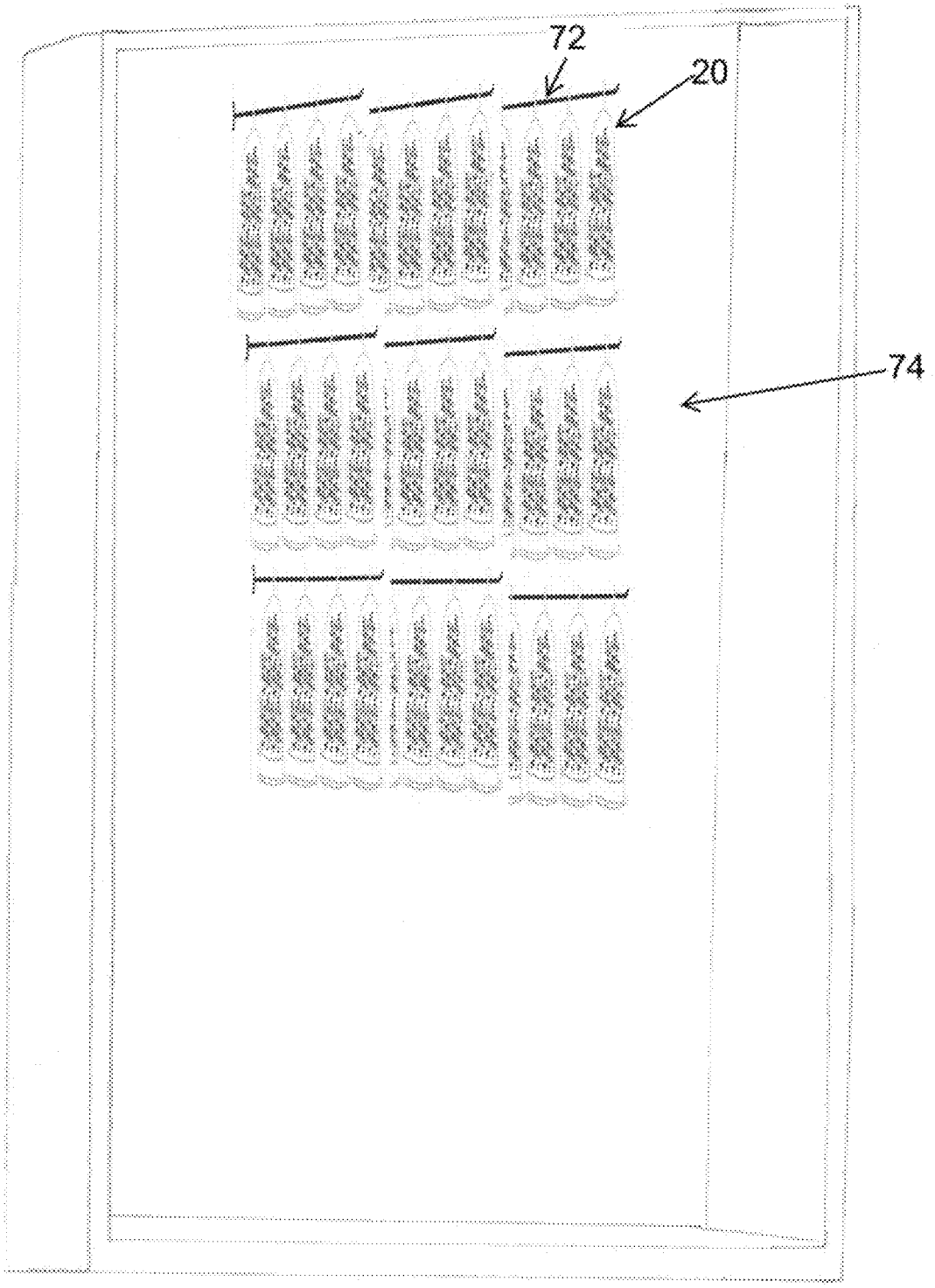
FIG. 13 illustrates a perspective view of a display shelf for the food packaging of the present disclosure.

Snack foods in bags are often displayed in stores by hanging them with a small hole in the top of the bag on small diameter, long rods extending out horizontally from display stands. An advantage of our packaging is that it can be displayed at stores in the same way without need to change or alter display stands. The packaging of the present disclosure includes a small hole in the bottom of the packaging. Thus, our packaging hangs from the bottom hole on the same small diameter, long rods extending horizontally from typical display stands in stores (it is noted that although referred to as the bottom hole, when displayed on a store display rod it will be above the sealed food access opening of the refill and disposal packaging of the present disclosure). It is further noted that the present disclosure is not limited to hanging the bag from the bottom hole, and the semi-rigid ring may be operable to allow the refill and disposal packaging to stand on its own on a standard display shelf. FIGS. 12 and 13 illustrate an exemplary store display having unopened bags on display for sale.

FIGS. 12 and 13 illustrate a plurality of bags 20 containing fresh food items 22 therein on display for sale. In this example the display 74 may be a store display which has one or more rods or pegs 72 extending from the display 74 surface, which may be a vertical wall designed to accept the rods 72. The bags may in this example be hung from the hole 70 in the bottom 60 of the bag 20. Fresh food items 22 may be readily displayed, and the top seal 40 may operate to keep fresh food 22 in the bags 20. In some examples, indicia (not shown) such as labels, illustrations, pictures, brand names, and the like may be provided on the outer surface of the bag 20 or on an outer surface of the top seal 40. This allows a consumer to readily determine the type and flavor of the food items 22 and select the brand and flavor they desire.

How Result is Achieved

The consumer purchases snack food as packaged in packaging as depicted in FIG. 1. The consumer removes the foil seal 40 to gain access to the snack food. The snack food is transferred to a Squeezable Container and Dispenser Assembly (and Method of Use), such as SQEEDS®. The remaining (now empty) packaging (with the foil seal 40 removed) is inserted into the top opening 104 of the SQEEDS cylinder 102. The lip 95 of the ring seal 30 may optionally be wrapped around an upper rim 105 of the cylinder 102. However, the ring seal 30 may instead rest on top of the rim 105 of the cylinder to help prevent the ring 10 and bag 20 from slipping further into the interior of the cylinder 102, as well as providing a lip 95 for interfacing with a seating channel 90 of the top cap 110. The top cap 110 is placed over the packaging and cylinder 102. The food product (or other material) is accessed by squeezing the bottom-cap 130 and forcing slit 134 to an open condition. Residual, inedible (or other) material is deposited into the bag 20 by squeezing the top-cap 110 and forcing slit 114 to an open condition.

As the food product is consumed, the volume of the food product decreases. Correspondingly, the volume available for the bag 20 and residual, waste material increases. This is achieved because of the variable usable volume of the bag 20. This variable volume is illustrated in at least FIG. 11.

Figure 10:
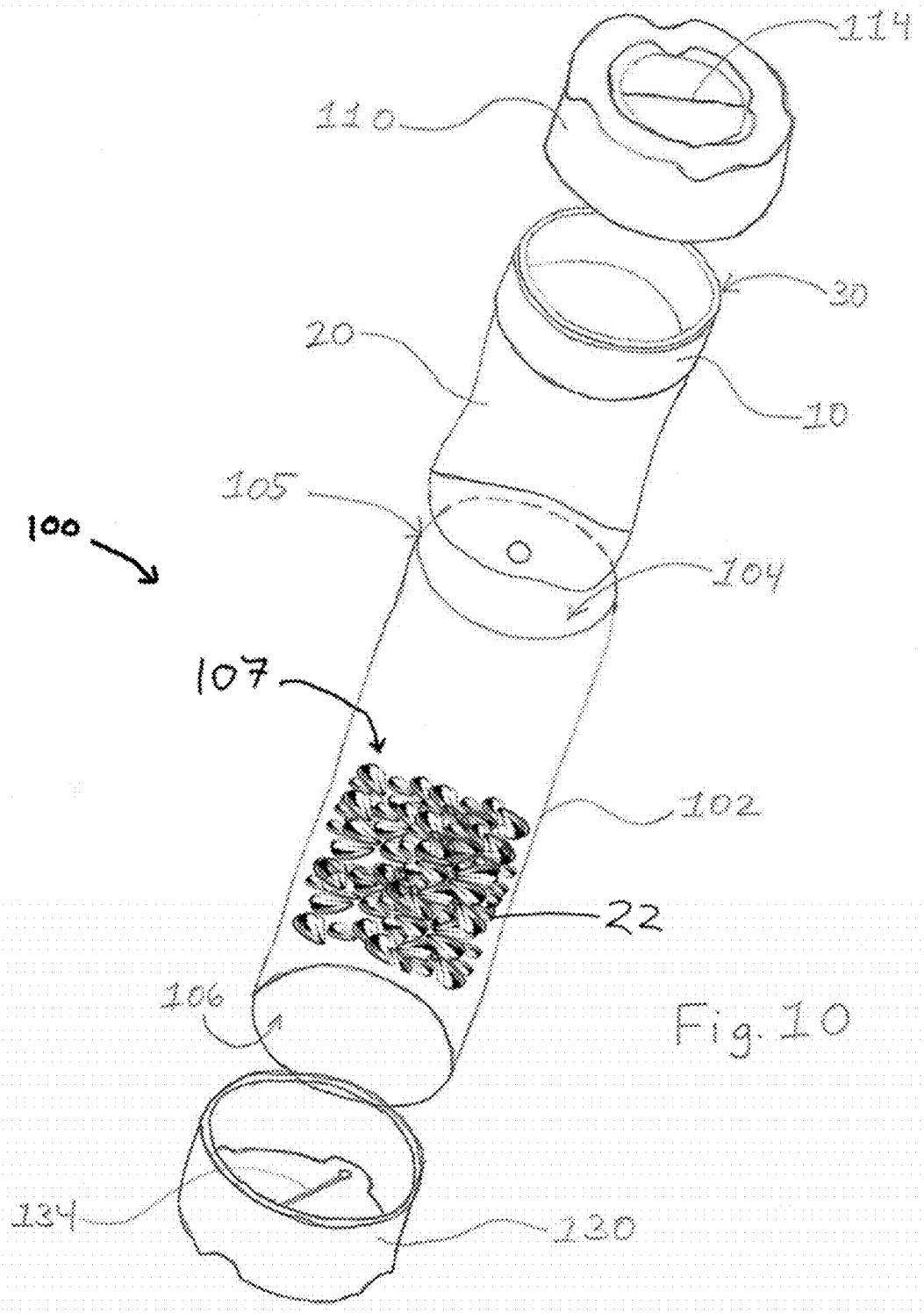
FIG. 10 is an exploded view of the opened packaging with a squeezable container and dispenser assembly.
Figure 15:
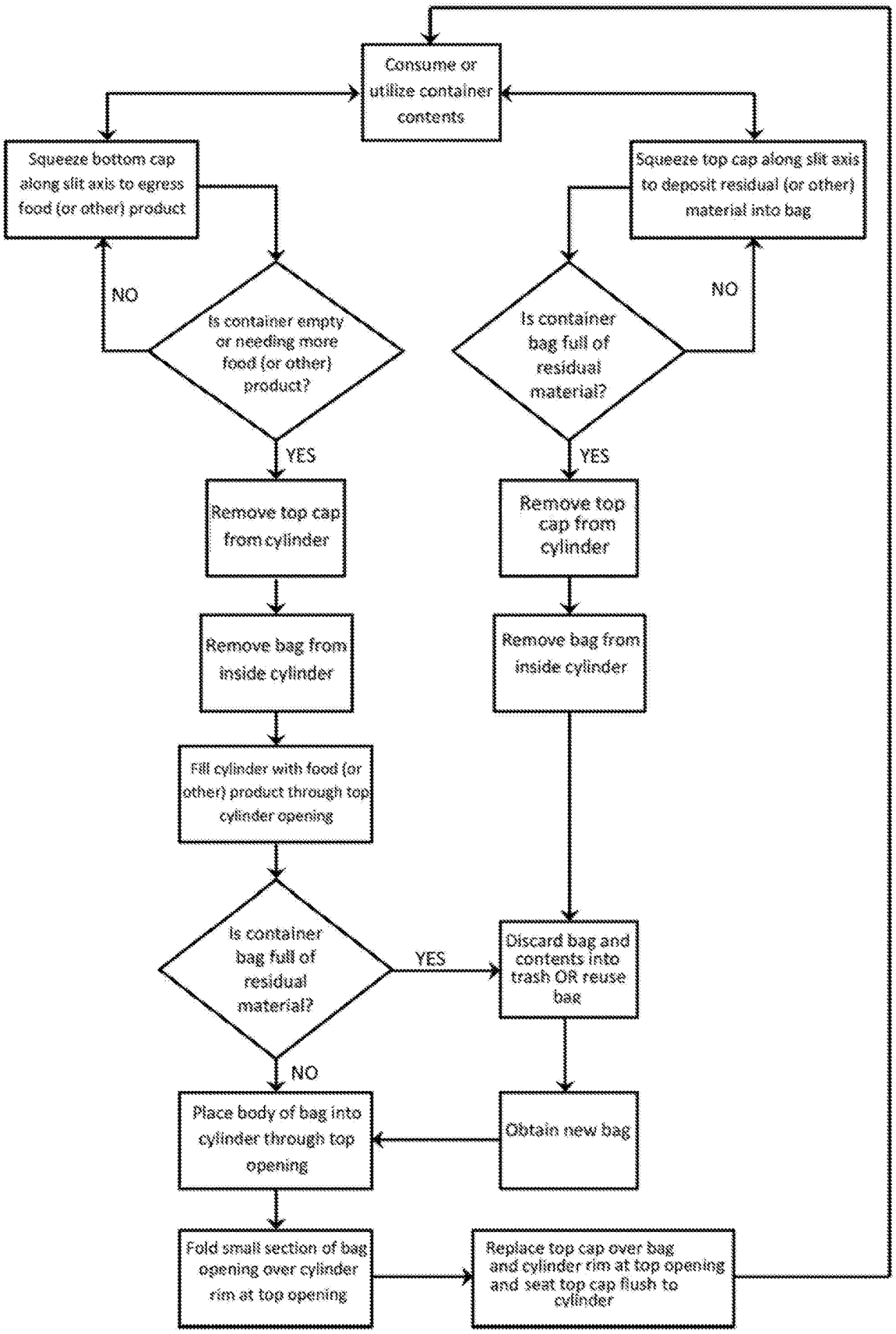
FIG. 15 illustrates an exemplary operational flow for using the assembly of FIG. 1.

Referring to FIG. 15, FIG. 15 is a flowchart of the general methodology for a consumer using the Dual Purpose Food Packaging Refill Container And Waste Receptacle with a Squeezable Container and Dispenser Assembly (and Method of Use), such as a SQEEDS® container discussed above and incorporated by reference in this disclosure. FIG. 10 illustrates the container assembly 100 in use. The food product 22 (or other material), is accessed by squeezing the bottom cap 130 and forcing aperture 134 to an open condition. Residual, inedible (or other) material is deposited into the bag 20 by squeezing the top cap 110 and forcing aperture 114 to an open condition.

As the food product 22 is consumed, the volume of the food product 170 is decreased, as shown in FIGS. 7B-7C of the SQEEDS® container incorporated by reference above in the '816 Application. Correspondingly, the volume available for the bag 22 and residual food items (or other material) increases as shown in FIGS. 7B-7C of the '816 Application. It is noted that for purposes of this discussion the bag 20 and associated structure of the instant disclosure may be used in place of the flexible barrier 150 of the '816 Application.

The consumer or user of the container follows the general methodology shown in FIG. 15 to consume food product, dispose of inedible residual or waste material, add more food product to the container, and/or remove the residual material waste.

Alternative Ways to Achieve Result

Alternate methods of achieving a packaging exist as would be known by those skilled in the art. Alternative methods of embodying the present disclosure may include alternate ring 10 materials such as, for example, vinyl, polystyrene, ethylene vinyl alcohol or polyethylene and the like. The foil seal 40 cover my also be a laminate of nylon, aluminum or a heatseal lacquer used to bond the aluminum to the sealing material 30, which may also be an alternate material conducive to volume manufacturing. Example material for both seals 30 and 40 could be supplied by Hueck Foils, Inc. of Eatontown, N.J., or aluminum foil, a thin tin layer, or a laminates utilizing, for example, Flexi FoilFree HB barrier film technology from ProAmpac of Cincinnati, Ohio.

Besides alternate materials, the bag 20, ring 10 and resulting assembled packaging could be any size. The typical size will be close to the typical size of sunflower seed packaging commonly sold today and able to hold commonly available amount of snack food.

The assembly methods, adhesives and energy methods of affixing the materials together can vary as would be known by those skilled in the art. In addition, the automated machinery developed to produce the packing of the present disclosure could perform the assembly in various or alternative steps and sequences and achieve the same resulting packaging.

Manufacturing of the packaging could be performed by starting with flat material. With this manufacturing option, a continuous length of plastic bag 20 material could first be affixed to a continuous length of ring 10 material and then a continuous length of foil 30 material affixed over both the bag 20 and ring 10. The continuous length of assembled material would then be cut to the proper diameter, then rolled into the cylindrical ring shape. Leaving an extra section of ring seal 30 material would provide a mechanism to join the ends of the ring together. The bag 20 would then be sealed on both the side and the bottom 60 with heat or other conventional means.

In manufacturing, the practice of replacing the oxygen in the package with nitrogen may be performed before sealing the packaging.

The packaging of the present disclosure could fit within other containers besides the Squeezable Container and Dispenser Assembly (and Method of Use) discussed. When used with a Squeezable Container and Dispenser Assembly (and Method of Use) the top cap 110 may or may not contain a seating channel 90 and/or lip 95.

Providing consumers with packaging that keeps the snack food fresh, can be stocked and displayed on conventional store racks and serves as a convenient disposal bag for residual, inedible food waste is an improvement over the simple plastic bags that snack foods are typically sold in today. With the packaging as presently disclosed, the snack food is kept fresh without the need for a Ziploc-type seal. Conventional snack food packaging typically consists of a bag that is either heat sealed at both ends or one end has a Ziploc-type seal and a perforated tear strip. The bags with heat seals on both ends are simply opened by tearing the plastic open at one end, typically at the top of the bag. The bags with Ziploc type seals are resealable, thus a perforated strip is implemented at the top of the bag so the consumer knows by tearing along this perforation that they are opening the bag for the first time after purchasing the snack food. Neither type of bag is conveniently conducive as a receptacle for inedible waste of the snack food contained therein and since the only use of this type of bag is to transport the snack food to the consumer, it is not as efficient and environmentally friendly as packaging developed for dual use, unlike the presently disclosed packaging system. Thus, the packaging of the present disclosure is advantageous as it both keeps the snack food fresh, transports the snack food to the consumer and serves as a convenient inedible snack food waste receptacle.

Often when someone purchases a bag of sunflower seeds, they have to acquire an additional receptacle to deposit the residual, inedible shells into. Options often include empty plastic cups, Styrofoam cups, paper cups, plastic bottles, glass bottles, tin or aluminum cans and the like. And, quite often using these cups or bottles to collect the residual snack food material is the only use of the cup or bottle, which is then discarded in a waste receptacle, resulting in a highly non-efficient and environmentally unfriendly use of the cup, bottle or can. The packaging of the present disclosure has the advantage of being both the packaging to deliver the snack food to the consumer and the packaging to collect the residual waste from the aforementioned snack food, thus, providing a highly efficient, dual-use, and environmentally friendly packaging option for snack food consumption. In addition, with the use of our packaging, the consumer no longer needs to waste the material or expense of a cup, bottle or can.

Furthermore, the dual purpose food packaging refill container and waste receptacle described in this disclosure provides a more hygienic mechanism for capturing food waste as compared to the common practice of simply spitting the food waste, such as sunflower seeds shells, into the environment and onto the ground. In 2020, in response to the Novel Coronavirus (SARS-CoV-2) which can cause Covid-19 infection, major league baseball stadiums have implemented restrictions to eliminate spitting, using smokeless tobacco, and sunflower seeds in restricted areas. The packaging of the present disclosure, by virtue of its design to receive waste food material such as sunflower shells, peanut shells, and the like, may provide means for fans to continue enjoying their favorite snack foods at games while complying with health regulations.

The packaging of the present disclosure is simple to manufacture in volume with food packaging automated machinery as would be known by someone skilled in the art. Few manufacturing steps are required to affix the bag to the ring, seal the bag, punch a hole in the bag, fill the packaging with a snack food, and seal the ring opening. Many of the manufacturing steps can be performed in parallel by automatic machinery, as will be apparent to those skilled in the art.

The foregoing description has been limited to a specific embodiment of the disclosure. It will be apparent, however, that variations and modifications can be made to the present disclosure, with the attainment of some or all of the advantages of the present disclosure.

Although specific features of the present disclosure are shown in some drawings and not others, this is for convenience only as some features may be combined with any or all of the other features in accordance with the disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

We claim:

1. A dual purpose receptacle for edible food items, comprising:

a ring having a first shape and a first opening at a first end and a second opening at a second end opposite the first end;

a flexible bag coupled to the ring and extending through the second opening and past the second end of the ring, the flexible bag having an opening at a first end to allow access to an inner volume of the flexible bag for storing edible food items and receiving remnant waste of said edible food items, and wherein the bag is sealed at a second end opposite the first end ;

a ring seal provided at least partially in contact with the flexible bag, the ring seal configured to couple the flexible bag to the ring and to form an impervious air-tight and water-tight barrier;

a top seal coupled to the first end of the ring, the top seal configured to form an impervious air-tight and water-tight barrier for the inner volume of the flexible bag; and wherein the flexible bag and ring seal are at least partially inserted in the ring, at least a portion of the ring seal is wrapped over a first end of the ring, wherein the inner volume of the flexible bag is accessible through the first opening of the ring and the first end of the flexible bag.

2. The dual purpose receptacle of claim 1, wherein the inner volume of the flexible bag is configured to store edible food items and, after said edible food items are dispensed, receive remnant waste of said edible food items.

3. The dual purpose receptacle of claim 1, wherein the ring seal is coupled to an inside surface of the first end of the flexible bag and wherein the ring seal is further coupled to an outer surface of the ring.

4. The dual purpose receptacle of claim 3, wherein the ring seal is coupled to the inner surface of the flexible bag and the outer surface of the ring using an adhesive.

5. The dual purpose receptacle of claim 1, wherein the top seal is coupled to the first end of the ring and configured to form a removable seal with the first opening of the ring and configured to seal the inner volume of the flexible bag.

6. The dual purpose receptacle of claim 1, wherein the second end of the flexible bag is closed.

7. The dual purpose receptacle of claim 6, wherein the closed second end is sealed using a heat seal or adhesive, and further comprises one or more holes in said closed second end for hanging the dual purpose receptacle.

8. A system for storing edible food items and the remnant waste of said edible food items, comprising:

a squeezable container assembly comprising:

a main body having a first opening at a first end and a second opening at a second end opposite the first end;

a first compartment formed by an inner volume of the main body;

a first cap coupled to the main body at the first end, a second cap removably coupled to the main body at the second end, the first cap comprising an aperture configured to allow access to the first compartment;

a dual purpose receptacle comprising:

a ring having a first shape and a first opening at a first end and a second opening at a second end opposite the first end;

a flexible bag coupled to the ring, the flexible bag having an opening at a first end to allow access to an inner volume of the flexible bag for storing edible food items and receiving remnant waste of said edible food items, and wherein the bag is sealed at a second end opposite the first end;

a ring seal provided at least partially in contact with the flexible bag, the ring seal configured to couple the flexible bag to the ring and to form an impervious air-tight and water-tight barrier;

a top seal coupled to the first end of the ring, the top seal configured to form an impervious air-tight and water-tight barrier for the inner volume of the flexible bag; and wherein the flexible bag and ring seal is at least partially inserted in the ring, and wherein the inner volume of the flexible bag is accessible through the first opening of the ring and the first end of the flexible bag; and wherein the dual purpose receptacle is inserted at least partially into the inner volume of the main body of the squeezable container at a second end thereof, and wherein the inner volume of the flexible bag forms a second compartment of the squeezable container assembly, the second compartment accessible via an aperture in the second cap of the squeezable container.

9. The system of claim 8, wherein the first and second compartments are variable in volume such that as edible food products are dispensed from the first compartment via the first aperture and inedible waste is deposited into the second compartment via the second aperture, a volume of the second compartment increases and a volume of the first compartment decreases.

10. The system of claim 8, wherein the second cap is configured to retain the dual purpose receptacle within the inner volume of the squeezable container.

11. The system of claim 8, wherein the second cap comprises a seating channel on an inner surface of the cap, the seating channel configured to receive a lip formed by a portion of the ring seal extending over the first end of the ring.

12. The system of claim 8, wherein the ring seal further comprises one or more tabs configured to wrap over the first end of the ring from and couple to an outer surface of the main body of the squeezable container assembly.

13. A method of using the system of claim 8, comprising:

obtaining the dual purpose receptacle;

removing the top seal thereby enabling access to the inner volume of the second compartment formed by the inner volume of the flexible bag;

pouring edible food items from the second compartment into the first compartment formed by the inner volume of the main body of the squeezable container assembly;

inserting the dual purpose receptacle into the second end of the squeezable container assembly such that the flexible bag and the ring of the dual purpose receptacle are substantially contained in the inner volume of the main body of the squeezable container assembly;

providing the second cap over the second end of the squeezable container assembly, the second cap configured to retain the dual purpose receptacle within main body of the squeezable container assembly; and dispensing edible food items from the first compartment through the aperture of the first cap, and receiving inedible food waste into the second compartment formed by the flexible bag via the aperture in the second cap.

* * * * *